US008653913B2

(12) United States Patent
Vellaiyanaicken et al.

(10) Patent No.: US 8,653,913 B2
(45) Date of Patent: Feb. 18, 2014

(54) FULLY RATED CONTACT SYSTEM HAVING NORMALLY OPEN CONTACT AND NORMALLY CLOSED CONTACTS

(75) Inventors: Palanisamy Vellaiyanaicken, Tamlinadu (IN); Rashmita Mohanty, Orissa (IN); Ryan Steven Schwan, Monroeville, OH (US)

(73) Assignees: TE Connectivity India Private Limited, Bangalore (IN); Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/484,540

(22) Filed: May 31, 2012

(65) Prior Publication Data

US 2013/0321107 A1 Dec. 5, 2013

(51) Int. Cl.
*H01H 67/02* (2006.01)
*H01H 9/00* (2006.01)

(52) U.S. Cl.
USPC ..... 335/126; 335/131; 335/177; 335/179; 335/180; 335/229

(58) Field of Classification Search
USPC ..... 335/126, 131, 177, 179–180, 229
See application file for complete search history.

(56) References Cited

U.S. PATENT DOCUMENTS

| | | | | |
|---|---|---|---|---|
| 7,924,124 | B2 * | 4/2011 | Leipold et al. | 335/177 |
| 2009/0231070 | A1 * | 9/2009 | Saruwatari et al. | 335/179 |
| 2011/0080240 | A1 * | 4/2011 | Patino et al. | 335/229 |

FOREIGN PATENT DOCUMENTS

DE 10 2011 014294 B3 3/2012

OTHER PUBLICATIONS

International Search Report, International Application No. PCT/US2013/039646, International Filing Date, Jun. 5, 2013.

* cited by examiner

*Primary Examiner* — Mohamad Musleh

(57) ABSTRACT

A contact system includes at least one first contact, at least one second contact, and at least one movable contact. A coil is provided which, when energized generates a force. A magnet is also provided, the magnet having a magnetic force. The forces of the coil and magnet attract the at least one movable contact to the at least one first contact. A return spring having a spring force cooperates with the at least one movable contact to return the at least one movable contact to the at least one second contact when the coil is not energized. The sum of the forces applied by the coil and the magnet are sufficient to overcome the spring force of the return spring to provide a balanced force to both the at least one second contact and the at least one first contact.

20 Claims, 5 Drawing Sheets

FULLY RATED CONTACT SYSTEM HAVING NORMALLY OPEN CONTACT AND NORMALLY CLOSED CONTACTS

FIELD OF THE INVENTION

The present invention is directed to a contact system which applies an optimal force to both the normally open contacts and the normally closed contacts, thereby yielding identical contact voltage drop values at both the open and closed contacts, eliminating the de-rating of the contacts at either the normally open or normally closed position.

BACKGROUND OF THE INVENTION

Relays and contactors are known devices used for switching of intended circuits/loads and the like. A relay is an electrically operated switch. Many known relays use an electromagnet to operate a switching mechanism mechanically, but other operating principles are also used. Relays are used where it is necessary to control a circuit by a low power signal or where several circuits must be controlled by one signal. A contactor is an electrically controlled switch used for switching a power circuit, similar to a relay except with higher current ratings.

In general, a simple electromagnetic relay consists of a coil assembly, a movable armature, and one or more sets of contacts, i.e. single throw system, double throw system, etc. The sets of contact include movable contacts, fixed normally open contacts, and fixed normally closed contacts. The armature is mechanically linked to one or more sets of moving contacts and is held in place by a spring.

When an electric current is passed through the coil assembly it generates a magnetic field that attracts the armature. The consequent movement of the movable contact(s) either makes or breaks (depending upon construction) a connection with a fixed contact(s). If the set of contacts was closed when the relay was de-energized, then the movement opens the contacts and breaks the connection, and vice versa if the contacts were open. When the current to the coil is switched off, the armature is returned by the spring force, of the return spring toward its relaxed position. Usually this force is provided by a spring, but gravity is also used commonly in industrial motor starters. Most relays and contactors are manufactured to operate quickly. In a low-voltage application this reduces noise; in a high voltage or current application it reduces arcing. In order to allow the proper movement of the contacts, the spring force is designed to be less than the force generated by the coil.

In the case of double throw contacts, the system dynamic forces are much more complex than with single throw contacts. The main difficulty lies in maintaining the contact pressure at the contact terminals of the normally closed points by use of the return spring. Thus a bulkier, more robust mechanism is required to achieve the force required to overcome the return spring on contact transfer. This often warrants the use of a larger coil which increases the size and cost of the switch, relay, or contactor.

Referring to FIG. 1, a system according the prior art is shown. The system has a set of normally closed fixed contacts P1 which forms the top of the assembly and it is the terminal side where the contactor offers the continuity, in the de-energized or rest position. A set of normally open fixed contacts P4 is provided on a base P5 and is activated when the coil is in the energized condition. A moveable contact set P3 is positioned between the fixed contacts P1, P4 and is moveable between them. A contact spring P2 cooperates with the movable contact set P3 to move the contact set with a pre-defined pressure. A core rod or armature P6 cooperates with a plunger P7 and carries the set of moveable contacts for actuation/transfer. A return spring P8 cooperates with the movable contacts P3. A magnetic coil assembly P10 having a coil lid P11, an inner coil P12, and coil shell P13 cooperates to move the movable contact set P3.

In operation, energizing the coil assembly P10 with a pre-designed voltage sets the flux around the system and causes plunger P7 to move down, thereby resulting in a downward movement of the core rod P6, which results in the compression of return spring P8. This results in transfer of position of moveable contacts P3 from being in contact with the normally closed fixed contacts P1 to being in contact with the normally open fixed contacts P4. De-energizing coil assembly P10 resets return spring P8, plunger P7, rod P6 and movable contacts P3 to their initial positions. Accordingly, the resultant force of the contact springs P8 alone determines the contact pressure on the normally closed fixed contacts P1. Due to the constrained parameters of this design, the return spring P8 has to be designed with a weaker pre-load (de-energized) for proper pickup and dropout, resulting in de-rating of the normally fixed contacts P1. Therefore, for an identical contact rating of current, a lower contact force at the normally closed fixed terminals results in higher voltage drop values than experienced at the normally open fixed terminals. This necessitates the side of the higher voltage drop be de-rated to a lesser amperage, in order to maintain acceptable voltage drop values and temperature rise limits which may otherwise ruin the system due to the higher drop values.

It would, therefore, be beneficial to provide a contact system which eliminates the problems associated with the prior art and which provides for bi-directional switching without any loss in the voltage drop values.

SUMMARY OF THE INVENTION

An exemplary embodiment of a contact system includes at least one first contact, at least one second contact, and at least one movable contact. A coil is provided which, when energized generates a force which attracts the at least one movable contact to the at least one first contact. A magnet is also provided, the magnet having a magnetic force which attracts the at least one movable contact to the at least one first contact. A return spring having a spring force cooperates with the at least one movable contact to return the at least one movable contact to the at least one second contact when the coil is not energized. The sum of the forces applied by the coil and the magnet are sufficient to overcome the spring force of the return spring to provide a balanced force to both the at least one second contact and the at least one first contact.

Another exemplary embodiment is of a contact system includes at least one normally open contact, at least one normally closed contact, and at least one movable contact. A coil assembly is provided which, when energized generates a force which attracts the at least one movable contact to the at least one normally open contact. A magnet is also provided, the magnet having a magnetic force which attracts the at least one movable contact to the at least one normally open contact. A return spring, having a spring force, cooperates with the at least one movable contact to return the at least one movable contact to the at least one normally closed contact when the coil assembly is not energized. The sum of the forces applied by the coil assembly and the magnet are sufficient to overcome the spring force of the return spring to provide a balanced force being applied to both the at least one normally open contact and the at least one normally closed contact.

An exemplary method of moving at least one movable contact between at least one first contact and at least one second contact is disclosed. The method comprising; energizing a coil assembly, the coil assembly when energized generates a force; generating a magnetic force from a magnet; summing the forces generated by the coil assembly and the magnet to attract the at least one movable contact to the at least one second contact; de-energizing the coil assembly; and returning the at least one movable contact to the at least one first contact by a spring force. The sum of the forces applied by the coil assembly and the magnet are sufficient to overcome the spring force thereby providing a balanced force to both the at least one first contact and the at least one second contact, yielding an essentially identical contact voltage drop values at both the at least one first contact and the at least one second contact.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
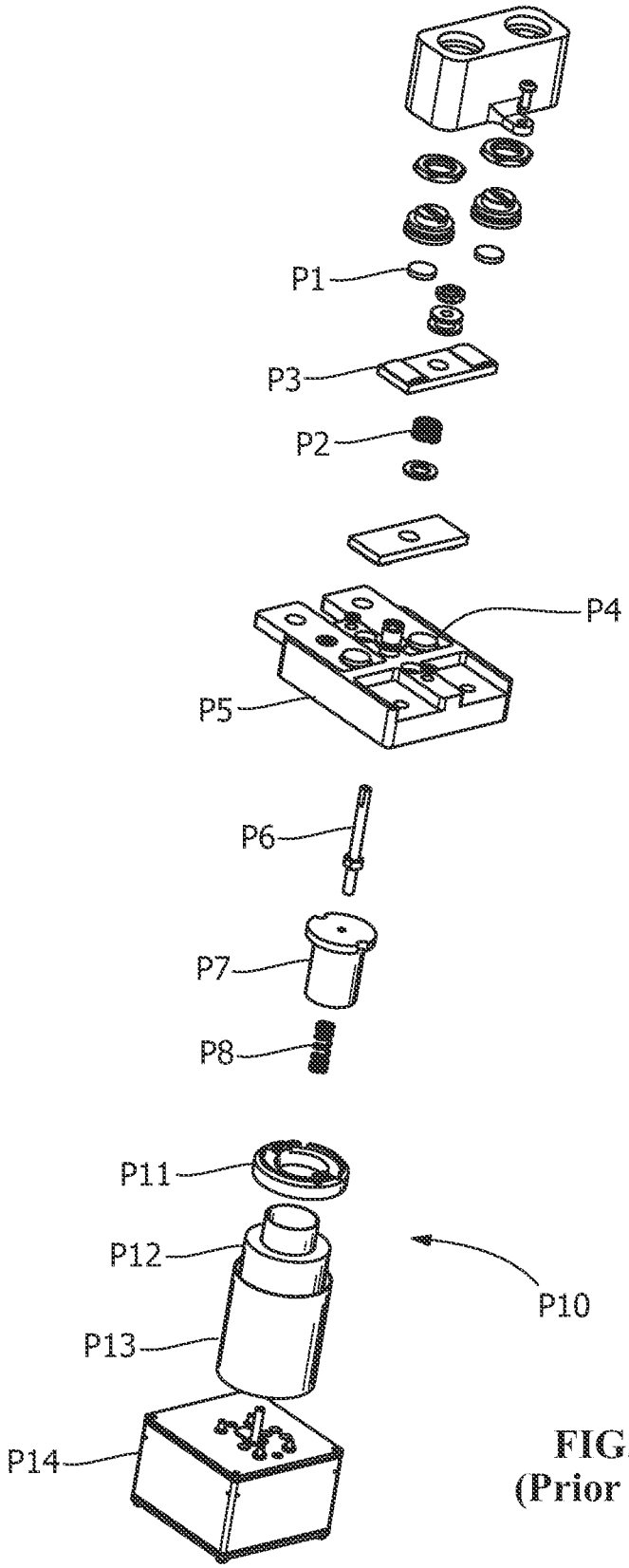
FIG. 1 (Prior Art)
FIG. 1 is an exploded perspective view of a prior art contact system of a prior art switch.
Figure 2:
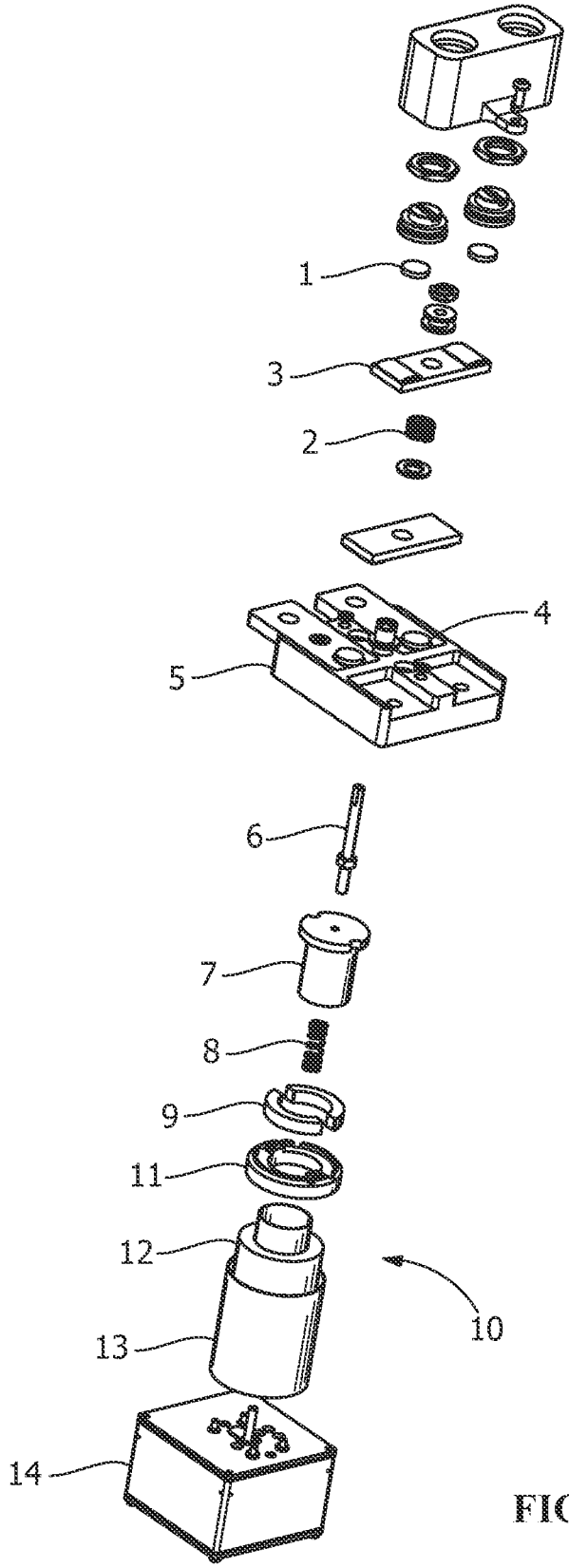
FIG. 2 is an exploded perspective view of an exemplary contact system of a switch according to the present invention.
Figure 3:
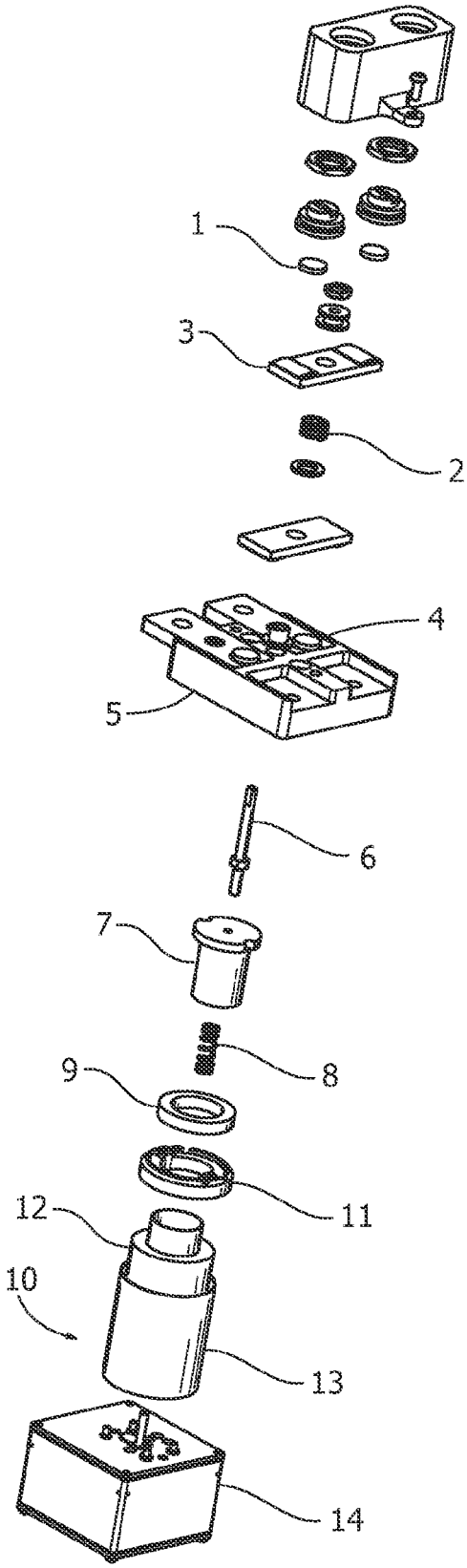
FIG. 3 is an exploded perspective view of an alternate exemplary contact system of a switch according to the present invention.

The present invention will be described more fully hereinafter with reference to the accompanying drawings, in which illustrative or exemplary embodiments of the invention are shown. In the drawings, the relative sizes of regions or features may be exaggerated for clarity. This invention may, however, be embodied in many different forms and should not be construed as limited to the exemplary embodiments set forth herein; rather, these embodiments are provided so that this disclosure will be thorough and complete, and will fully convey the scope of the invention to those skilled in the art.

It will be understood that spatially relative terms, such as "below", and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "over" the other elements or features. Thus, the exemplary term "below" can encompass both an orientation of over and under. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise.

Referring to FIGS. 2 through 5, an exemplary contact system for use with bi-directional and bi-polar contacts is shown. The contact system may be used in a switch, relay, contactor, or other similar device. The system has one or more normally first or closed fixed contacts 1 which forms the top of the assembly. In the exemplary embodiment shown, a set of two contacts 1 are provided. One or more normally second or open fixed contacts 4 are provided on a base 5. In the exemplary embodiment shown, a set of two contacts 4 are provided. One or more moveable contacts 3 are positioned between the fixed contacts 1, 4 and are moveable between them. In the exemplary embodiment shown, a set of two movable contacts 3 are provided.

It will be understood that the terms "first" and "second" related to the contacts 1, 4 are used for ease of description and are not meant to be limiting. The term "first" contact may be directed to the normally closed fixed contact, to the normally open fixed contact, or any other type of contact which can be used. Similarly, the term "second" contact may be directed to the normally open fixed contact, to the normally closed fixed contact, or any other type of contact which can be used.

A contact spring 2 cooperates with the movable contacts 3 to move the contacts 3 with a pre-defined pressure. A core rod or armature 6 which cooperates with a plunger 7 and carries the moveable contacts for actuation/transfer. A return spring 8 cooperates with the movable contacts. A magnet 9 is positioned about the circumference of the plunger 7. The magnet 9 maybe a one piece ring (FIG. 3) or a two piece ring (FIG. 2) or any other configuration which provides the magnetic forces required. A coil assembly 10 having a coil lid 11, an inner coil 12, and coil shell 13 is provided below the magnet 9, as viewed in the Figures. An auxiliary switch 14 is provided proximate the coil assembly 10.

The magnet 9 sits at a pre-calculated distance circumferentially away from the main plunger 7 and core rod 6. The magnet 9 is interposed at the path of the plunger, thereby aiding in the force (summation) applied by the moving contacts 3 to the fixed contacts 4 when the coil is energized, as will be more fully described.

Figure 4:
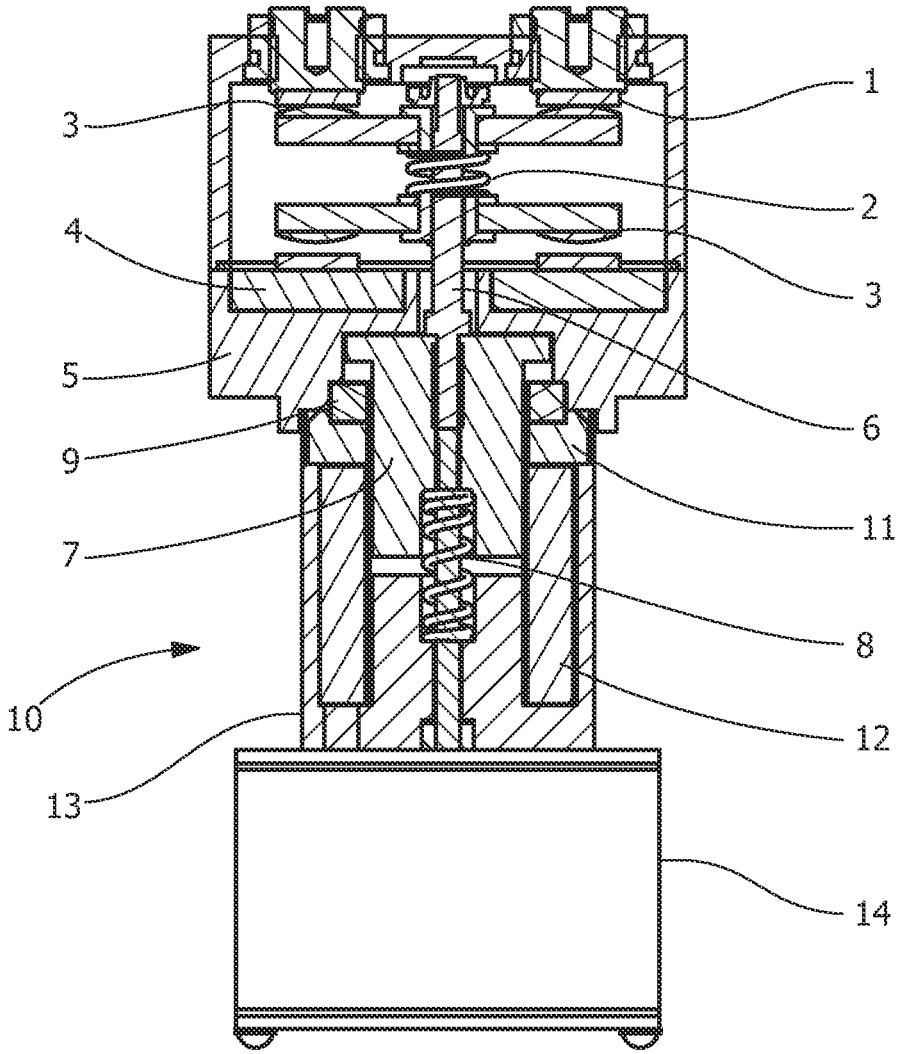
FIG. 4 is a partial cross-sectional view of the assembled switch showing the switch in a de-energized mode in which movable contacts engage normally closed fixed contacts.
Figure 5:
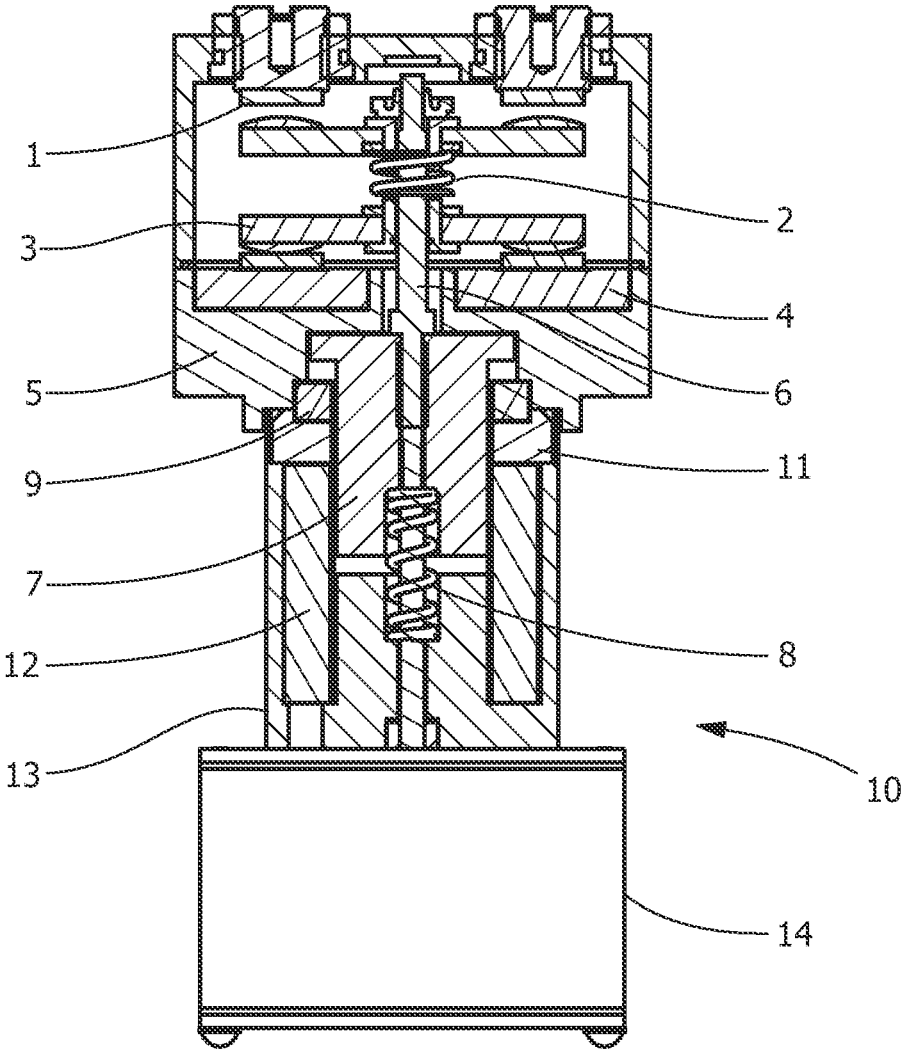
FIG. 5 is a partial cross-sectional view of the assembled switch showing the switch in an energized mode in which movable contacts engage normally open fixed contacts.

With Reference to FIG. 5, in operation, energizing the coil assembly 10 with the pre-designed voltage sets the flux around the system causes the coil assembly to exert a magnetic force which in turn causes the plunger 7 to move down as viewed in FIG. 5. The results in the downward movement of the rod 6, which in turn results in the compression of return spring 8. As this occurs, the movable contacts 3 are moved or transferred from the position shown in FIG. 4, in which the movable contacts 3 are in electrical and physical engagement with fixed contacts 1, to the position of FIG. 5, in which the movable contacts 3 are in electrical and physical contact with fixed contacts 4. De-energizing coil assembly 10 eliminates the force generated by the assembly 10 which allows the return spring 8, plunger 7, rod 6 and movable contacts 3 to return to their original or normal positions shown in FIG. 2.

With the incorporation of the magnet 9, a stronger return spring 8 can be used to overcome the need for de-rating of the normally closed contacts 1. As the magnet 9 and coil assembly 10 are in line below the movable contacts 3, the magnetic force of the magnet 9 and the magnetic force developed as the 10 is energized act together to attract the plunger 7 and movable contacts 3 toward the normally open fixed contacts 4. This sum of the forces applied by the coil assembly 10 and the magnet 9 are sufficiently large to overcome the stronger spring or resilient force of the stronger return spring 8. This allows the return spring to be designed to optimal standards to meet force/pressure requirements needed to carry full load rather than a potential 50% de-rating as required by the prior art systems. With the incorporation of the magnet 9, the operational parameters can be held within designated specifications for both pickup and dropout, allowing the system to operate quickly and reliably.

FIG. 5 illustrates the energized state of the coil assembly 10, where the moveable contacts 3 are transferred from the normally closed contacts 1 to the normally open contacts 4. The coil assembly 10 when activated, in conjunction with the magnet 9, pulls the plunger 7 and core rod 6 against the resilient or set up forces of the return spring 8 and contact spring 2, resulting in the yield of the required contact forces at the normally open fixed contacts 4.

FIG. 4 illustrates the de-energized state of the coil assembly 10, where the forces of the coil assembly 10 are removed allowing the return spring 8 to relax and move toward its unstressed position. This releases the core rod 6 and plunger 7, thereby transferring the movable contacts 3 from normally open fixed contacts 4 to the normally closed fixed contacts 1. The contact spring 2 and return spring 8 are designed to optimal standards to meet the force requirements needed to carry full load, i.e. to physically hold the normally closed contacts 1 at a position which requires a higher compensation. As previously stated, the addition of the magnet 9 allows the return spring to have a larger spring or resilient force which results in the movable contacts 3 exerting a higher yield force at the normally closed position (due to force summing of the enhanced return spring and the contact spring). This condition yields the same contact forces and contact voltage drops at the normally closed fixed contacts as experienced at the normally open fixed contacts. This balances the forces on either side of the contact system.

As described, the addition of the magnet in the path of travel of the moving elements allows for the use of an optimal preloaded return spring. This results in an optimal force being applied to both the normally open contacts and the normally closed contacts, thereby yielding identical or essentially identical contact voltage drop values at both the open and closed contacts, eliminating the de-rating of the contacts at either normally open or normally closed positions. An appropriate magnet is used depending upon the number of contacts; thereby providing optimization can be done for any sized contact system. The force compensation by the addition of magnet overcomes the issues of de-rating of the contact systems associated with the products found in the prior art.

The invention as described and illustrated with respect to the exemplary embodiments provides a bi-directional switch without any loss of the voltage drop values. As a result, the contact system provides a balanced contact force at both normally open and normally closed contacts. In addition, a balanced temperature rise (approximately equal) between the normally open and normally closed contacts is accomplished and the voltage drop across the normally open contacts and the normally closed contacts becomes identical or essentially identical. As the operation of the system is symmetrical about the contacts, without any offset in force/pressure, the bi-directional, bi-polar, identical contact ratings at both the normally open contact and normally closed contacts render the assembly a full rated switch, relay, contactor or the like, for its intended applications.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A contact system comprising:

at least one first contact;

at least one second contact;

at least one movable contact, the at least one movable contact being movable between the at least one first contact and the at least one second contact;

a coil which, when energized generates a force which attracts the at least one movable contact to the at least one first contact;

a magnet having a magnetic force, the magnet attracts the at least one movable contact to the at least one first contact, the force generated by the coil and the magnetic force of the magnet causes the at least one movable contact to move against the at least one first contact with a first contact force;

a return spring having a spring force, the return spring cooperates with the at least one movable contact to return the at least one movable contact to the at least one second contact when the coil is not energized, the force generated by the return spring causes the at least one movable contact to move against the at least one second contact with a second contact force, the first contact force and the second contact force being essentially identical;

whereby the sum of the forces applied by the coil and the magnet are sufficient to overcome the spring force of the return spring to provide a balanced force to both the at least one second contact and the at least one first contact, yielding an essentially identical voltage drop when the at least one movable contact is moved against the at least one first contact or the at least one second contact.

2. The contact system as recited in claim 1, wherein the at least one second contact is a set of two normally open contacts, the at least one first contact is a set of two normally closed contacts, and the at least one movable contact is a set of two movable contacts.

3. The contact system as recited in claim 2, wherein a contact spring is provided between the movable contacts, the contact spring cooperates with the movable contacts to move the movable contacts with a pre-defined pressure.

4. The contact system as recited in claim 1, wherein an armature which cooperates with a plunger carries the at least one moveable contacts between the at least second contact and the at least one first contact.

5. The contact system as recited in claim 4, wherein the magnet is positioned about the circumference of the plunger.

6. The contact system as recited in claim 4, wherein the magnet is positioned circumferentially away from the plunger and armature and is interposed at the path of the plunger to aid in the force summation when the coil is energized.

7. The contact system as recited in claim 1, wherein the magnet is a one piece ring.

8. The contact system as recited in claim 1, wherein the magnet is a two piece ring.

9. A contact system comprising:

at least one normally open contact;

at least one normally closed contact;

at least one movable contact, the at least one movable contact being movable between the at least one normally open contact and the at least one normally closed contact;

a coil assembly which, when energized generates a force which attracts the at least one movable contact to the at least one normally open contact;

a magnet having a magnetic force, the magnet attracts the at least one movable contact to the at least one normally open contact, the force generated by the coil and the magnetic force of the magnet causes the at least one movable contact to move against the at least one normally open contact with a first contact force;

a return spring having a spring force, the return spring cooperates with the at least one movable contact to return the at least one movable contact to the at least one normally closed contact when the coil assembly is not energized, the force generated by the return spring causes the at least one movable contact to move against the at least one normally closed contact with a second contact force, the first contact force and the second contact force being essentially identical;

whereby the sum of the forces applied by the coil assembly and the magnet are sufficient to overcome the spring force of the return spring to provide a balanced force being applied to both the at least one normally open contact and the at least one normally closed contact, yielding an essentially identical voltage drop when the at least one movable contact is moved against the at least one normally open contact or the at least one normally closed contact.

10. The contact system as recited in claim 9, wherein the at least one movable contact is a set of two movable contacts, a contact spring is provided between the movable contacts, the contact spring cooperates with the movable contacts to move the movable contacts with a pre-defined pressure.

11. The contact system as recited in claim 9, wherein an armature which cooperates with a plunger carries the at least one moveable contacts between the at least one normally open contact and the at least one normally closed contact, the magnet is positioned about the circumference of the plunger.

12. The contact system as recited in claim 9, wherein the magnet is a one piece ring.

13. The contact system as recited in claim 9, wherein the magnet is a two piece ring.

14. The contact system as recited in claim 9, wherein the balanced force applied to both the at least one normally open contact and the at least one normally closed contact yields an essentially identical contact voltage drop values at both the at least one normally open contact and the at least one normally closed contact.

15. The contact system as recited in claim 9, wherein the at least one normally open contact is fixed and the at least one normally closed contact is fixed.

16. A method of moving at least one movable contact between at least one first contact and at least one second contact, the method comprising;

energizing a coil assembly, the coil assembly when energized generates a force;

generating a magnetic force from a magnet;

summing the forces generated by the coil assembly and the magnet to attract the at least one movable contact to the at least one second contact, the force generated by the coil and the magnetic force of the magnet causing the at least one movable contact to move against the at least one first contact with a first contact force;

de-energizing the coil assembly;

returning the at least one movable contact to the at least one first contact by a spring force, the spring force causing the at least one movable contact to move against the at least one second contact with a second contact force, the first contact force and the second contact force being essentially identical;

whereby the sum of the forces applied by the coil assembly and the magnet are sufficient to overcome the spring force thereby providing a balanced force to both the at least one first contact and the at least one second contact, yielding an essentially identical contact voltage drop values at both the at least one first contact and the at least one second contact.

17. The method as recited in claim 16, wherein the at least one movable contact, the at least one first contact and the at least one second contact are used in a relay.

18. The method as recited in claim 16, wherein the at least one movable contact, the at least one first contact and the at least one second contact are in a contactor.

19. The method as recited in claim 16, wherein the at least one movable contact is a set of two movable contacts, a contact spring is provided between the movable contacts, the contact spring providing a pre-defined pressure to the movable contacts.

20. The method as recited in claim 16, wherein an armature which cooperates with a plunger carries the at least one moveable contacts between the at least one first contact and the at least one second contact, the magnet is positioned about the circumference of the plunger.

* * * * *